United States Patent [19]

Armstrong

[11] 4,332,357

[45] Jun. 1, 1982

[54] STRIP FEEDING

[75] Inventor: David A. Armstrong, Swansea, Wales

[73] Assignee: British Steel Corporation, England

[21] Appl. No.: 180,620

[22] Filed: Aug. 25, 1980

[30] Foreign Application Priority Data

Aug. 21, 1979 [GB] United Kingdom ..... 7929076

[51] Int. Cl.[3] ..... B21C 47/02; B65H 19/08; B65H 19/18

[52] U.S. Cl. ..... 242/78.1; 242/55; 226/118

[58] Field of Search ..... 226/118, 119; 242/55, 242/55.16, 78, 78.1, 78.3, 78.6, 78.7, 78.8

[56] References Cited

U.S. PATENT DOCUMENTS

| | | | |
|---|---|---|---|
| 2,195,008 | 3/1940 | Lessmann | 242/78.1 |
| 2,338,143 | 1/1944 | Taylerson | 226/118 |
| 2,865,639 | 12/1958 | Gillette et al. | 226/118 X |
| 3,365,144 | 1/1968 | Daub | 242/78.1 |
| 3,507,433 | 4/1970 | Davidow | 226/119 X |

*Primary Examiner*—Stanley N. Gilreath
*Attorney, Agent, or Firm*—Bacon & Thomas

[57] ABSTRACT

A method for producing continuous feed of strip from finite lengths includes producing coils by locating strip at a predetermined point along its length, in the gap between two segments of a mandrel and rotating the mandrel so that the strip feeds from two directions for coiling.

10 Claims, 14 Drawing Figures

STRIP FEEDING

Figure 1:
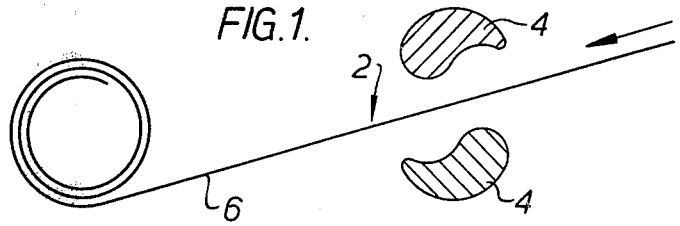

This invention relates to the provision of a continuous feed of strip from individual batches. It is particularly, though not exclusively, concerned with the storage of strip in processes where a continuous and uninterrupted feed of strip derived from individual coils is required.

In such continuous processes, batches of strip in for example the form of coils must be joined in order to produce a substantially continuous length. The process of joining involves a time period during which no strip is made available for feeding from the coil last-in-line. To maintain continuous feed of strip into, for example, a continuous annealing line, a reservoir of strip must be provided, the length of strip in the reservoir being at least equivalent to the demand of the line during the period when lengths from sequential coils are being joined.

A number of proposals have been made for the storage of strip. All involve a relatively large storage area coupled with complex equipment for maintaining a variable run of strip within the area. In for example the continuous cold reduction line at the Weirton Plant of the National Steel Corporation, as disclosed in "Iron and Steel Engineer" September 1976, an under floor storage system is sized to accommodate four spaced accumulator lengths of strip effective to provide a total storage length of 1000 ft. This permits a one hundred and fifty second stop of the tail of strip stored in the accumulator to enable it to be welded to the leading edge of strip offered from the following coil.

To the extensive area and cost of such a storage system, must be added the complexity and running cost of the necessary entry and outlet bridles and looping cars and it is one object of the present invention to produce inter-alia a strip storage system of reduced complexity and size.

According to the broadest aspect of the present invention, a mandrel for producing coil of strip comprises at least two portions separated by a gap between which the strip may be located for coiling.

According to a further aspect of the present invention, a method for producing a coil of strip comprises locating the strip at a pre-determined point along its length in the gap between two portions of a mandrel, and rotating the mandrel so that strip is fed from two directions for coiling.

According to a yet further aspect of the present invention, a method for producing continuous feed of strip from finite lengths comprises producing coils by winding the strip onto a mandrel having at least two portions separated by a gap between which the strip is located for coiling, feeding the head of one coil into apparatus requiring continuous feed of strip by unwinding of the coil, suitably storing the other end portion of the coil released during unwinding to enable the tail of this end portion to be secured to the head of the next coil, whereby to maintain continuous feed. Preferably the portions are segments of half cylinders, with the gap between the half cylinders extending substantially transversely of the axis of rotation. Suitably the surfaces of the segments within the gap are complimentary and are radiused to ensure that strip fed into, contained within and emerging from the gap is bent to the smallest possible extent.

Conveniently the segments are radially movable to enable the gap to be widened for threading and for unthreading of the strip and to be closed for winding and unwinding. The segments may be movable by any convenient means for example by hydraulic or mechanical actuations incorporated in the mandrel.

The mandrel may be provided with strip retaining flanges at one or both of the axial ends of the segments. However, no flange need be provided if adequate strip guidance systems are disposed adjacent the mandrel. With this arrangement the gap between the segments is exposed to ease the threading and the unthreading of strip.

It will be appreciated that during winding of strip on to the mandrel of the present invention, strip will be fed from two different, conveniently opposite directions. The amount of strip which is wound from each of the two directions will depend upon the length of strip which is required to be fed back during unwinding for the purpose of storage and/or welding. Accordingly, before winding of the coil begins, a length of strip determined by the amount to be stored will need to be threaded through and clamped in the gap between the segments. The strip may be threaded from a conventionally wound coil by any coiling and uncoiling arrangement of the type well known in the art or from a coil box.

Figure 2:
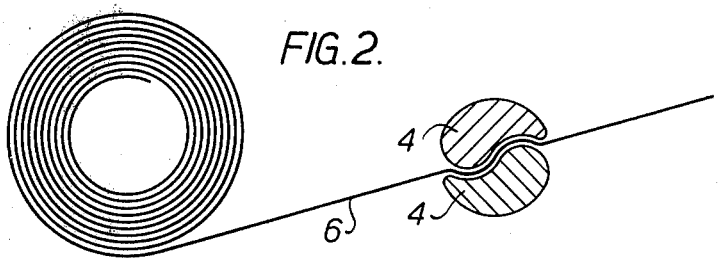
Figure 3:
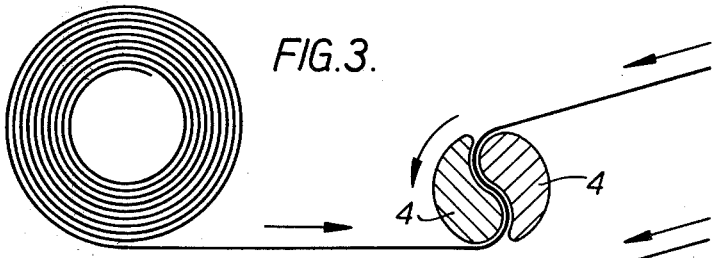
Figure 4:
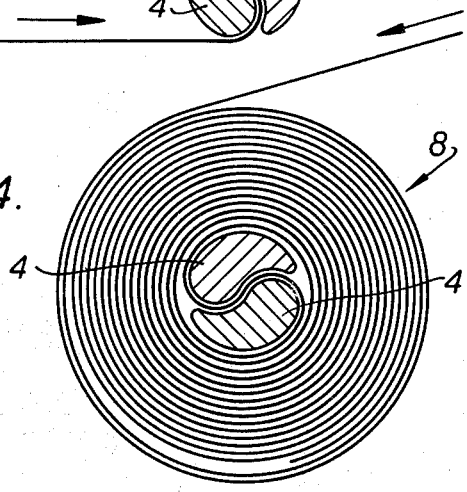

An embodiment of the invention will now be particularly described by way of example with reference to the accompanying drawings in which:

FIG. 1–3 are schematic end on views of a mandrel according to one aspect of the present invention and illustrate a sequence of the stages of a coil winding operation according to a further aspect, FIG. 4 is a schematic end on view of the mandrel of FIGS. 1–3 with a coil of strip substantially fully wound; and FIGS. 5–13 are schematic side views of an installation for producing a continuous feed of strip by the use of coils as illustrated in FIG. 4.

Figure 14:
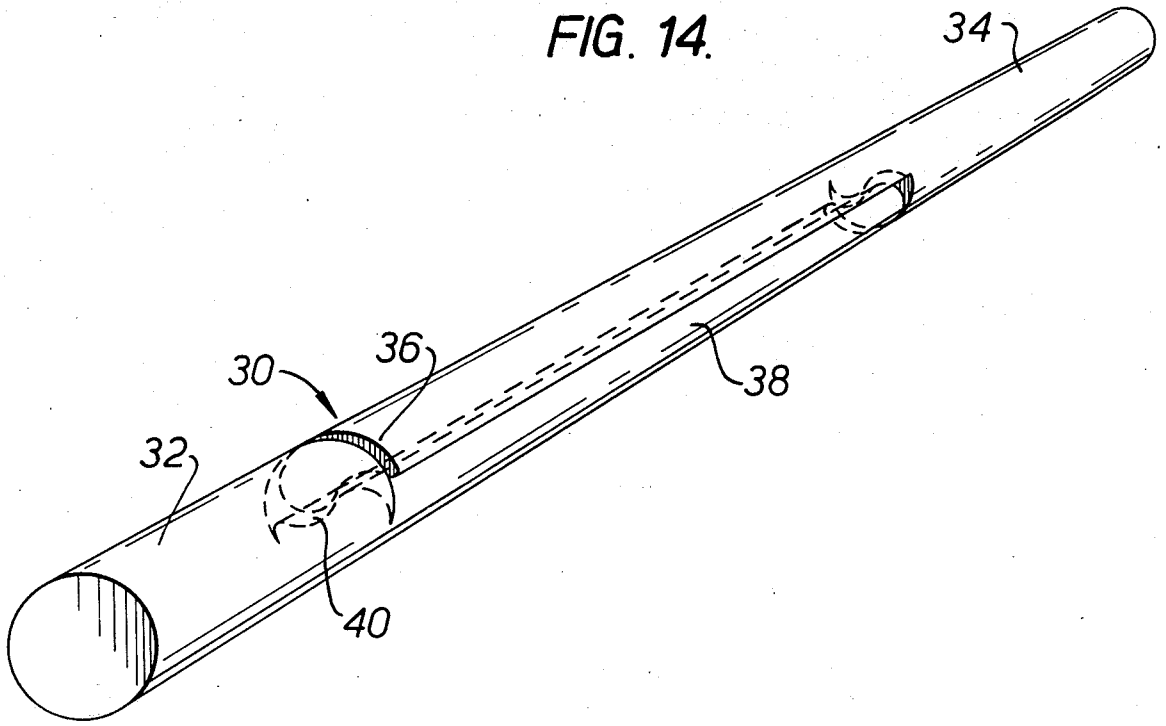

FIG. 14 is a schematic side view of an alternative form of the mandrel illustrated in FIG. 1.

Referring to FIG. 1 of the drawing the mandrel indicated generally at 2 comprises two substantially half cylindrical segments 4 secured to means by which they can be rotated to wind on a length of strip indicated generally at 6. The strip for winding on to the mandrel conveniently is derived from a conventional coil of the type well known in the art.

The segments 4 also are arranged, by way of the well known mechanical expedients available, to be movable radially of the axis of rotation of the mandrel so that the gap between them can be enlarged or closed. The segments are separated to enable strip to be threaded through the gap for winding and to subsequently release strip after unwinding. The segments are closed up to grip the strip for winding in a manner which reduces bending to a minimum. As shown in FIGS. 1–3, the surfaces of the segments within the gap together with their outer peripheries are radiused accordingly; the profiles of the segments within the gap also are complimentary to ensure adequate grip on the strip.

To wind strip derived from a conventional coil onto the mandrel 2, the segments 4 are separated as shown in FIG. 1 and between one-third and one-half of the coil length is threaded through the gap by a conventional coil/uncoiler combination. After threading, the segments 4 are closed up and the mandrel rotated in the direction shown in FIG. 3. As also illustrated in FIG. 3, strip is fed onto the mandrel for winding, from two opposite directions to produce the coil shown in FIG. 4 in which respective layers from the two feed directions are interleaved.

FIGS. 5–13 illustrate a sequence of operations producing a continuous feed of strip into for example a strand annealing line. The coils used in the sequence are of the type illustrated in FIB. 4 and are joined together for example by welding in conventional manner.

Figure 5:
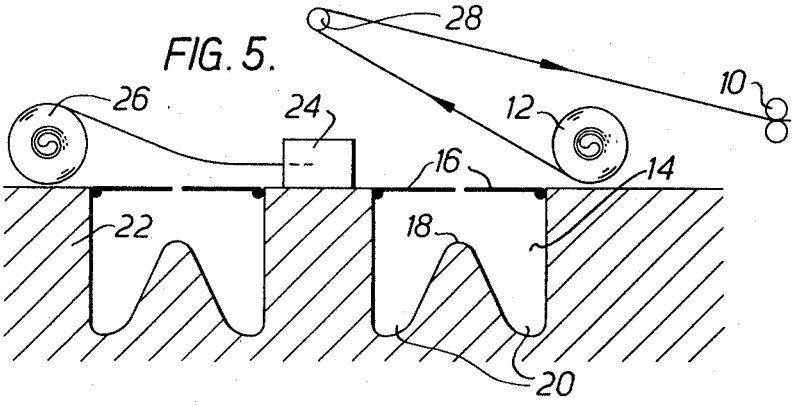

FIG. 5 exemplifies the stations in the sequence of operations by which strip is continuously fed through the nip between a pair of line entry rolls 10.

Standing to the rear of the rolls 10 is an uncoiling station 12 loaded with a coil 8 of the form shown in FIG. 4. The uncoiling station 12 stands adjacent and at the forward end of an accumulator 14 provided with a pair of downwardly opening doors 16. The doors 16 are effective to close off the accumulator chamber flush with the shop floor during the period when no strip is contained for storage.

Accumulator 14 has a central saddle 18 between troughs 20. The troughs and the saddle are radiused to enable the strip to be folded in loops within the chamber in the manner illustrated in FIG. 7 with the minimum of bending.

Interposed between the accumulator 16 and a similar accumulator 22 is a welding station indicated generally at 24. The welder used at station 24 is of any conventional type suitable for the gauge of the strip to be fed to the continuous processing line. An uncoiling station 26 similar to station 12 is provided at the rearward end of welding station 24.

To provide continuous feed of strip through the rolls 10, coils such as coil 8 are loaded at stations 12 and 26. The head of the coil at station 12 is threaded through the nip of rolls 10 by way of a tensioning roll 28; the heat of the coil at 26 is threaded into the welder 24 ready for joining.

Figure 6:
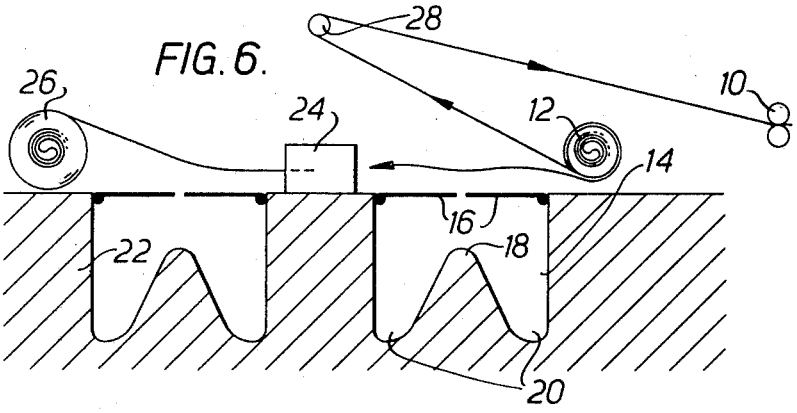

In the sequence of operations beginning with the arrangement of FIG. 5, the doors of accumulator 14 and 22 are closed. Uncoiling of the coil at station 12 feeds strip through rolls 10 until the tail is exposed as shown in FIG. 6. Continued unwinding produces the reverse effect of the winding operation illustrated in FIG. 3, namely the tail end of strip in the coil will continue to emerge rearwardly in the direction shown by the arrow in FIG. 6.

Figure 7:
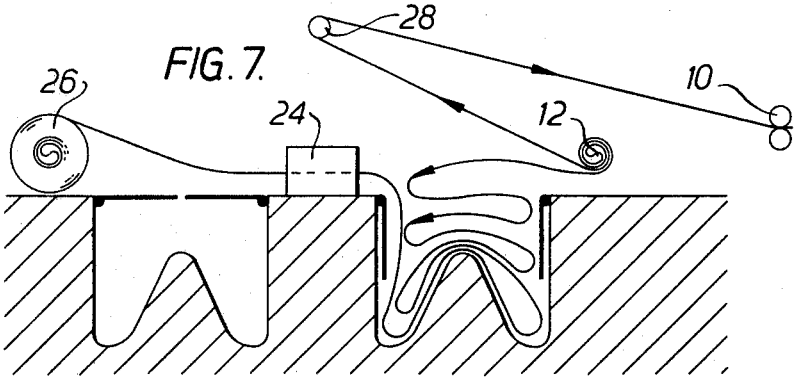

This rearwardly emerging tail is secured in welder 24 for joining on to the head of strip derived from the coil at station 26. Strip which continues to be discharged rearwardly by progression of unwinding at station 12 is, as shown in FIG. 7, stored by folding in accumulator 14 after opening of doors 16.

Figure 8:
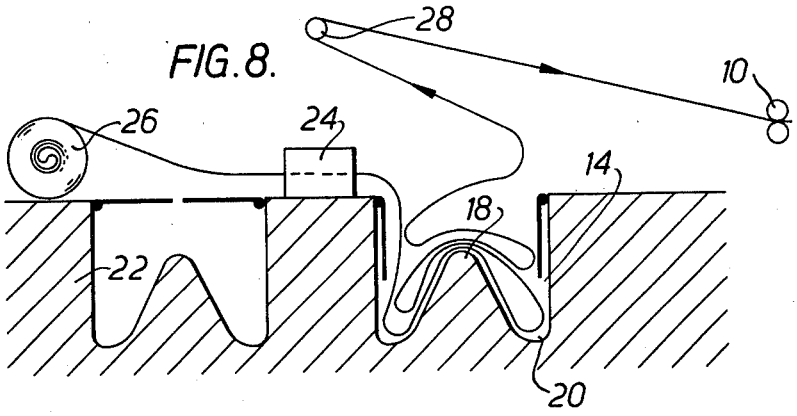

On completion of uncoiling at station 12 and as shown in FIG. 8, the empty mandrel is removed while strip in accumulator 14 continues to be made available without interruption for continuous feed through rolls 10. The length of strip back coiled on the mandrel and the capacity of accumulators 14 and 22 are selected so that the length of stored strip available is consistent with the period required for welding at station 24.

Figure 9:
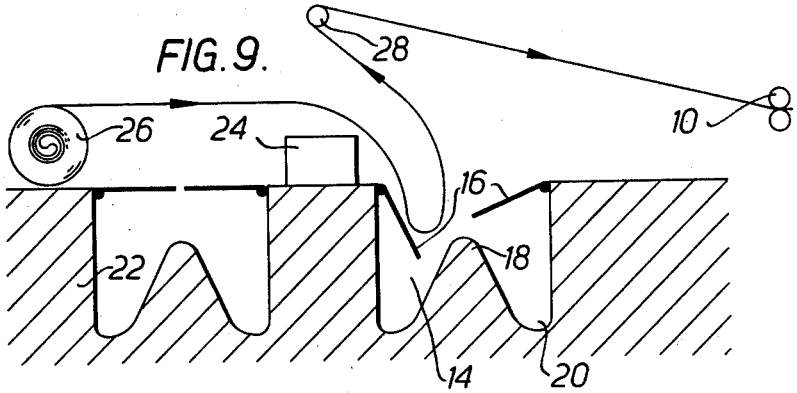
Figure 10:
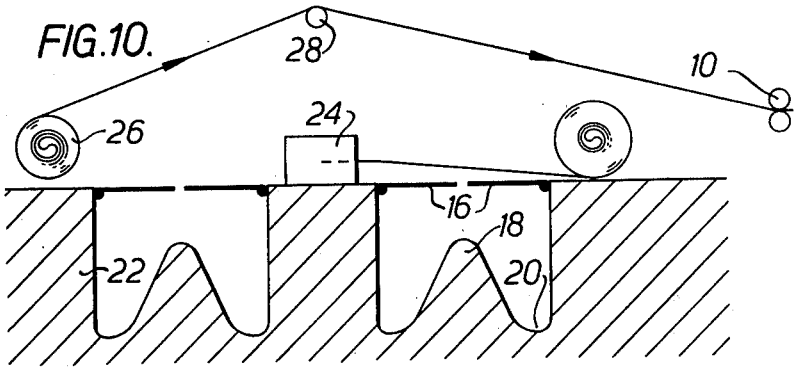

With accumulator 14 empty as shown in FIG. 9, doors 16 are closed and strip continues to be fed from the coil at station 26 while a fresh coil is replaced at station 12 in the manner illustrated in FIG. 10.

Figure 11:
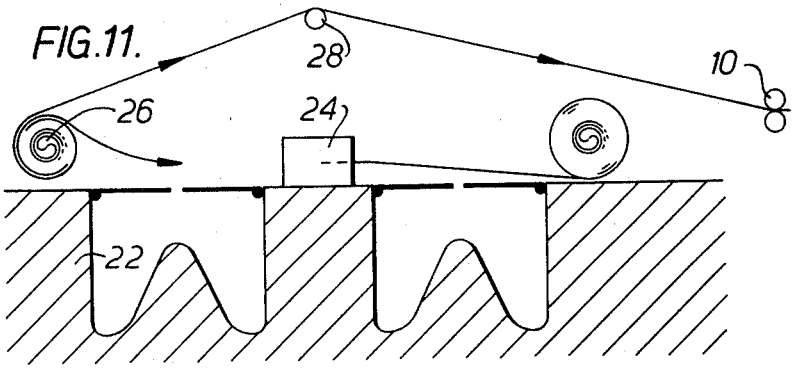
Figure 12:
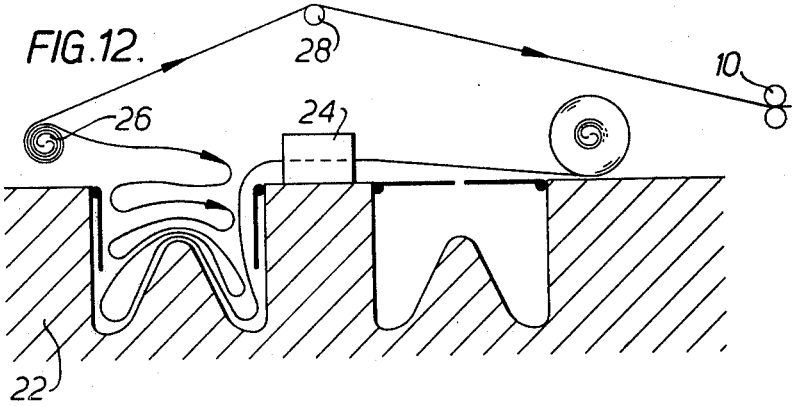
Figure 13:
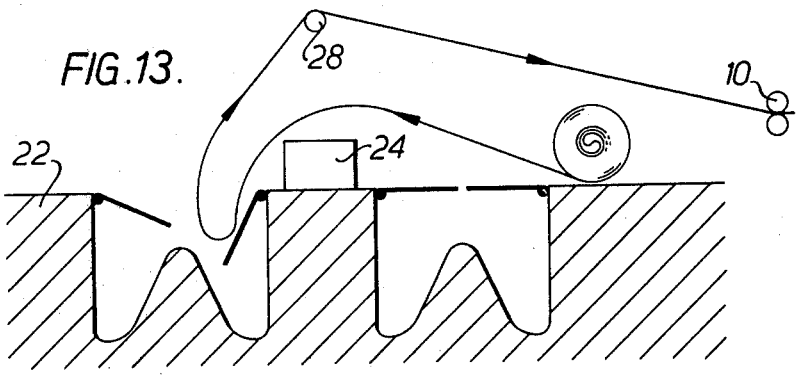

As previously recited and as shown in FIG. 11, the tail of the coil at station 26 is fed to the head of the fresh coil at station 12 for welding at station 24. The tail end of strip discharged rearwardly at station 24 proceeds as illustrated in FIG. 12 to be stored in accumulator 22 to ensure no interruption in the continuity of feed at least during welding. As illustrated in FIG. 13, when accumulator 22 is discharged, strip for continuous feeding is provided by the coil at station 12 while the empty mandrel at station 22 is replaced by the fresh coil. The sequence of operations beginning with that of FIG. 4 is now repeated.

FIG. 14 shows an alternative form of mandrel to that shown for FIG. 1. In FIG. 14 the mandrel 30 comprises two aligned cylinders, 32, 34 both of whose axially outer ends are arranged to be driven in synchronism. The axially inner ends of the cylinders are cut away, preferably along a diameter as shown to leave complimentary semi-cylindrical segments 36, 38 which are separated by a gap 40 effective to retain the strip to be wound. The strip retaining gap may be increased and decreased either by axial or relative movement of the cylinders relative to one another.

As illustrated in FIG. 14, the complimentary surfaces within the gap of the segments are radiused in like manner to that shown in FIG. 1 to reduce to a minimum the bending of strip retained within the gap.

While in the embodiment of the invention strip wound onto the mandrel 2 of FIG. 1 is derived from strip wound around a conventional mandrel, it may equally be wound from strip derived from a coil box.

It will be appreciated that while the invention has been described with reference to the steel strip it can be applied to any other material with the necessary changes in the joining operation. It will equally be appreciated that the invention provides storage of reduced capacity and complexity particularly since strip can be discharged from the accumulators of the invention in the same way as it is fed in; this obviates the need for complex storage loops, bridles and looping cars.

We claim:

1. A method for producing continuous feed of strip from finite lengths comprising producing a plurality of coils by winding each strip on to a mandrel having at least two portions separated by a gap between which the strip is located and completing a series of cycles, each cycle comprising unwinding one of said coils to feed the head thereof into apparatus requiring said continuous feed and to feed the tail-end thereof to a fixed station whilst storing the balance of the tail end of said coil in a first accumulator, and unwinding another of said coils to feed the head thereof to the fixed station for attachment to the tail end of said one coil whereby to maintain a continuous feed; the tail end of said other coil subsequently being fed to said fixed station whilst the balance of its tail end is stored in a second accumulator.

2. A method according to claim 1, wherein the strip is located at between one-third and one half of its length between the two portions of the mandrel before rotation for coiling.

3. A method as claimed in claim 1 wherein the tail of one coil is secured to the head of the next coil by welding.

4. A method as claimed in claim 3 wherein the capacity of each accumulator is selected so that the length of storing strip available is consistent with the period required for welding.

5. Apparatus for producing continuous feed of strip from finite lengths comprising a first and a second uncoiling station for uncoiling coil produced from strip wound on to a mandrel having two portions separated by a gap between which the strip may be located for coiling, a strip accumulator adjacent each of the uncoiling stations and disposed between them to receive strip unwound from the coils together with a station intermediate the accumulators for securing the head of one coil to the tail of the other coil.

6. Apparatus as claimed in claim 5 wherein the station for securing strip comprises a welding station.

7. Apparatus as claimed in claim 5 or claim 6 wherein each accumulator comprises a chamber dimensioned to accommodate convoluted strip.

8. Apparatus as claimed in claim 7 wherein the chamber base has a central saddle providing troughs which define the strip convolutions.

9. Apparatus as claimed in claim 8 wherein the accumulator is provided with closure doors at its upper end.

10. Apparatus as claimed in claim 6 in which an uncoiling station includes tensioning rolls.

* * * * *